United States Patent [19]

Walski

[11] 4,113,226

[45] * Sep. 12, 1978

[54] APPARATUS TO ADJUST AND MAINTAIN THE DISTANCE BETWEEN WALL FORMS

[75] Inventor: Stanley Walski, Media, Pa.

[73] Assignee: Con-Spec Devices Inc., Wilmington, Del.

[ * ] Notice: The portion of the term of this patent subsequent to Nov. 15, 1994, has been disclaimed.

[21] Appl. No.: 782,877

[22] Filed: Mar. 30, 1977

Related U.S. Application Data

[63] Continuation-in-part of Ser. No. 689,726, May 25, 1976, Pat. No. 4,058,285.

[51] Int. Cl.[2] ..... E04G 17/08

[52] U.S. Cl. ..... 249/216; 249/46; 249/219 W

[58] Field of Search ..... 249/40–46, 249/190–191, 213–214, 216–217, 219 W; 248/205 R; 85/1 R

[56] References Cited

U.S. PATENT DOCUMENTS

| | | | |
|---|---|---|---|
| 2,180,773 | 11/1939 | Simpson | 151/20 |
| 2,485,280 | 10/1949 | Grace | 85/1 R |
| 3,295,873 | 1/1967 | Attwood | 85/1 R |
| 3,693,931 | 9/1972 | Holt | 249/46 |
| 3,972,501 | 8/1976 | Plough | 249/42 |
| 3,981,476 | 9/1976 | Alexander et al. | 249/42 |

*Primary Examiner*—Francis S. Husar
*Assistant Examiner*—John McQuade
*Attorney, Agent, or Firm*—Karl W. Flocks

[57] ABSTRACT

A back side plate and a front side plate having a screw type wall tie passing therethrough maintain a strongback or waler therebetween by connecting tension stud bolts with a panel or wall form attached to a shelf portion of the back side plate with adjustments made through a housing and a keeper in conjunction with a nut which can be turned on the screw type wall tie.

14 Claims, 17 Drawing Figures

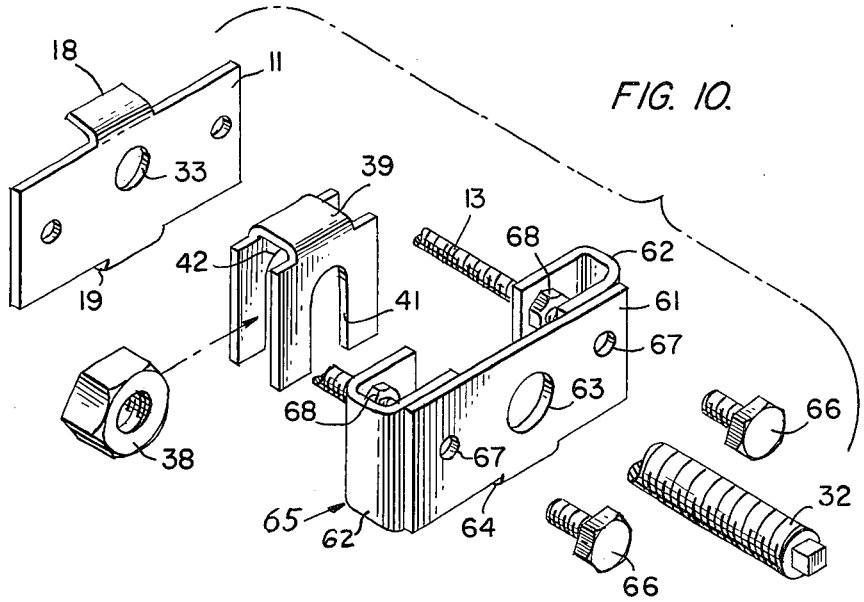
FIG. 10.
FIG. 11.
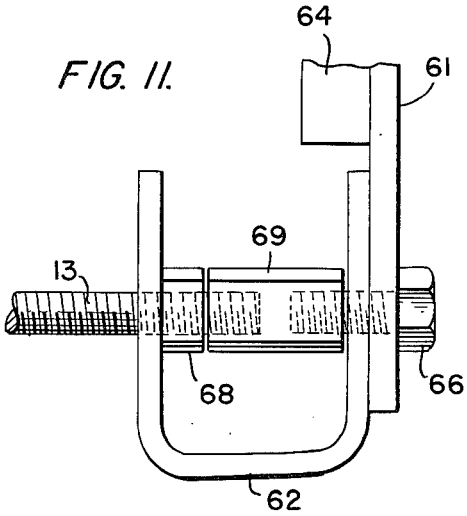
FIG. 12.
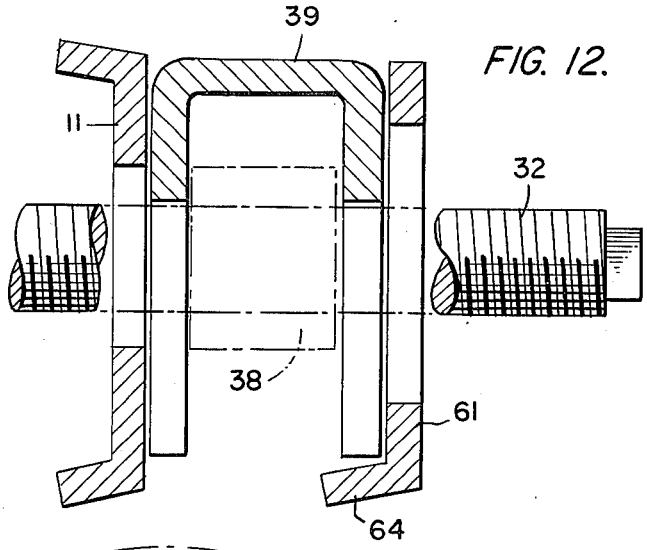
FIG. 13.
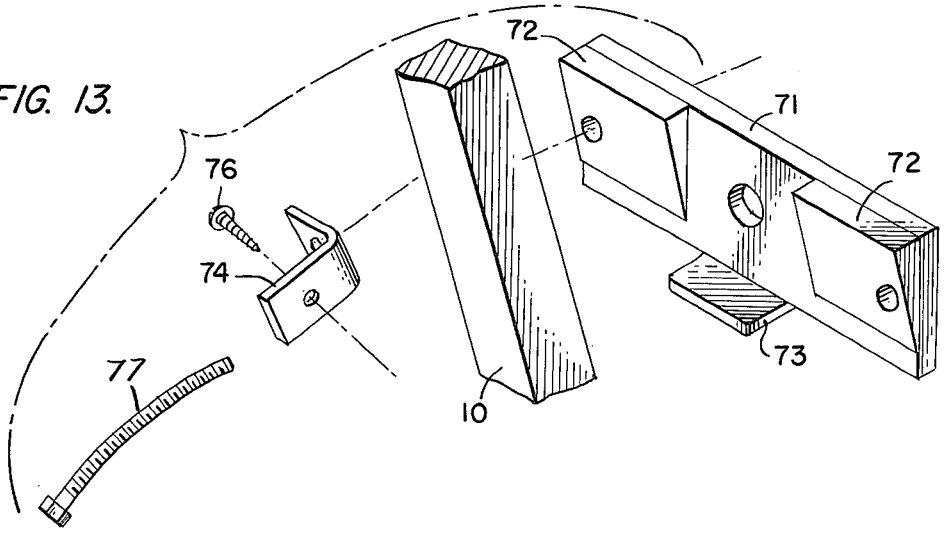

APPARATUS TO ADJUST AND MAINTAIN THE DISTANCE BETWEEN WALL FORMS

This application is a continuation-in-part application of the inventor's application Ser. No. 689,726, filed May 25, 1976, now U.S. Pat. No. 4,058,285 entitled "Apparatus to Adjust and Maintain the Distance Between Wall Panels and Wall Forms."

BACKGROUND OF THE INVENTION

The present invention relates to spacing of walls in the construction industry such as wall panels or wall form faces which are spaced to form the thicknesses of concrete walls, with wall ties connecting opposing walls and passing through the poured concrete. Most prior art wall forms must have special systems built specifically for that wall form and in addition may require special tools for adjustment purposes.

Use of screw type wall ties is known in the prior art but the hardware used in conjunction with such wall ties shows the use of special mounts and other parts which may require special tools for assembly or disassembly and which may be built for use with a particular wall form

SUMMARY OF THE INVENTION

The present invention is adaptable to spacing of wall panels including wall form faces and the maintaining of the distance between said wall faces.

The present invention is a system to hold and attach strongbacks and walers to any wall forms.

A further object of the present invention is to provide a space for centering and the passage of ties which maintain the spacing and may be used to adjust the spacing between wall forms.

An advantage of the present invention is that the system may be used and adapted for use with many different forms presently on the market.

A further object of the system is the provision of a nut used in conjunction with any threaded tie, being made captive so that a wall form can be moved in or out by the turning of the nut.

The present invention is adapted for use with ties passing through members which are to be spaced from each other with the spacing adjustable but maintained once the adjustment has been made.

BRIEF DESCRIPTION OF THE DRAWINGS

The above and other objects and advantages of the invention will become apparent upon full consideration of the following detailed description and accompanying drawings in which:

FIG. 10 is an exploded perspective view of a modified portion of a system of the type shown in FIGS. 1 and 2;

FIG. 11 is a plan view of a portion of the housing member and connecting parts of the modified system of FIG. 10;

FIG. 12 is a section view of the housing member and connecting parts of the modified system of FIG. 10.

FIG. 13 is a perspective view of a modified front plate and connecting parts for a battered or sloping form utilizing a system of the present invention;

DESCRIPTION OF THE PREFERRED EMBODIMENTS

Figure 1:
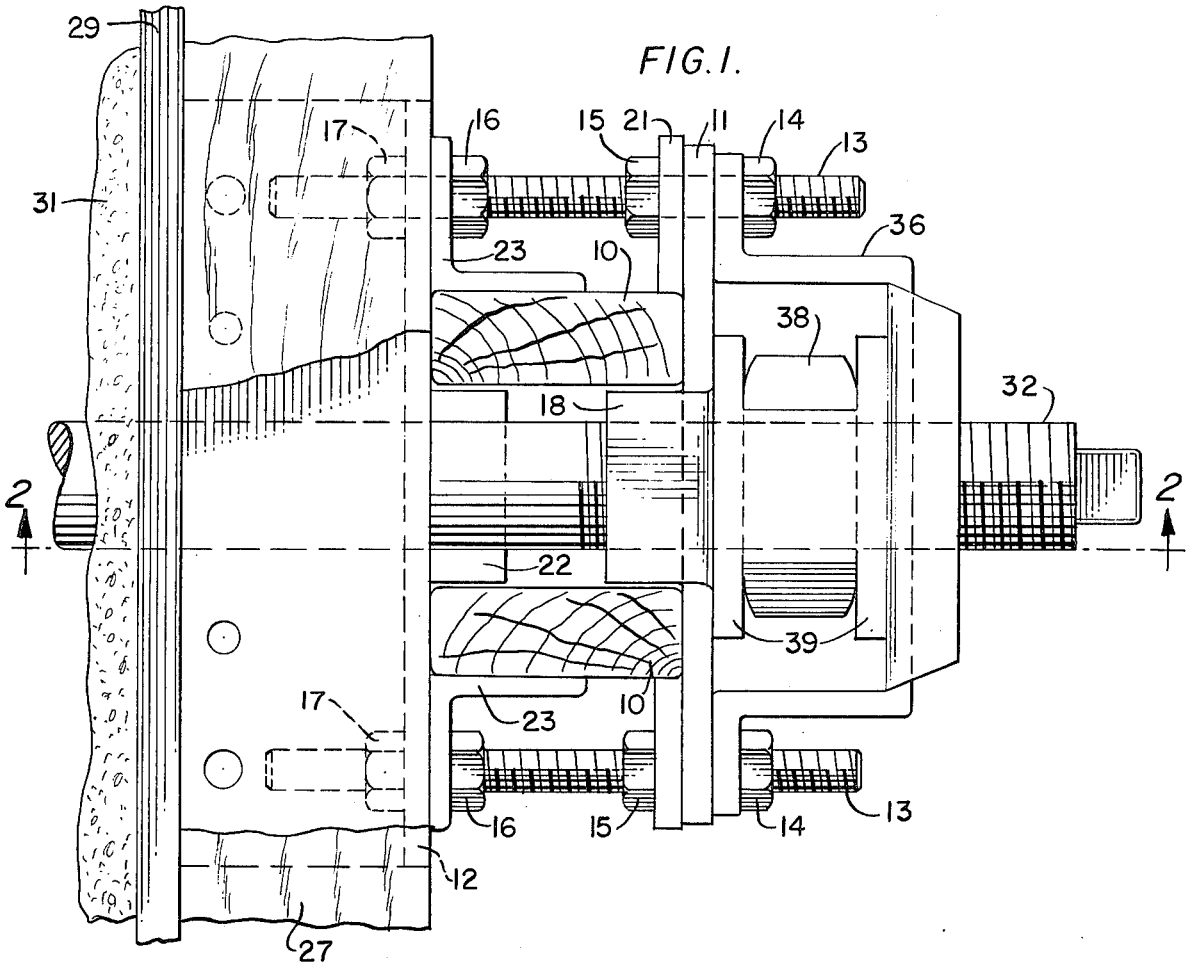
FIG. 1 is a plan view of the system of the present invention on the outside of the spacing between wall forms on one end of a tie.
Figure 2:
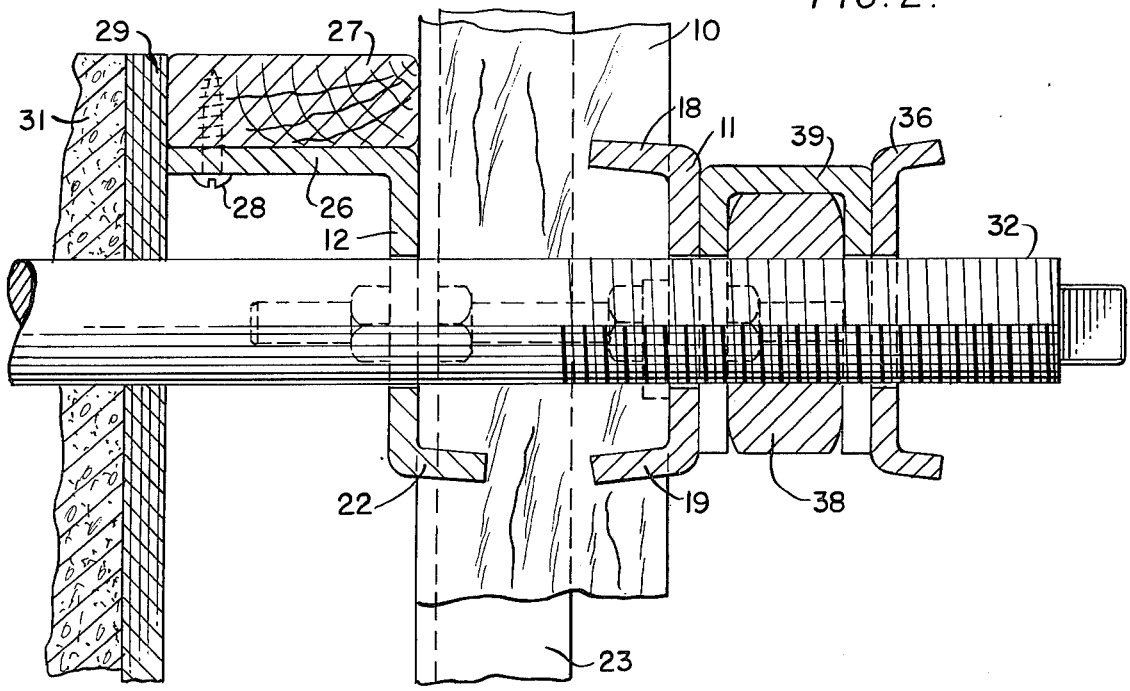
FIG. 2 is a section view along line 2—2 in FIG. 1.
Figure 3:
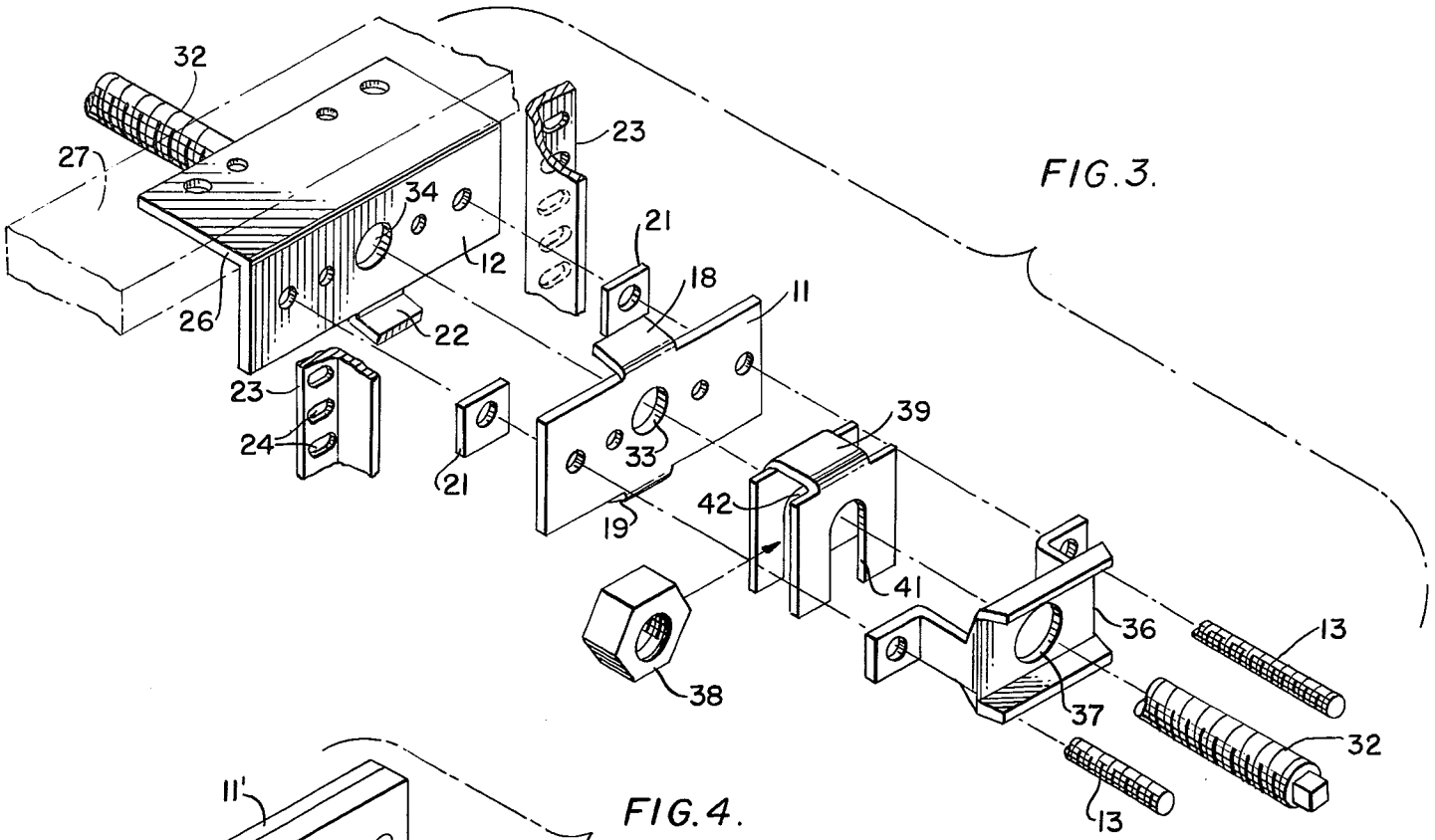
FIG. 3 is an exploded perspective view of the portion of the system shown in FIGS. 1 and 2.

Referring first to the embodiment of FIGS. 1 through 3 there is shown the use of the present system with building members such as wall forms for forming concrete structures therebetween but this system should not be considered only in this regard since other structural uses are of importance such as positioning of other building members such as panels and maintaining the position of these panels in a structure are equally applicable. In these figures strongbacks or walers which are structural members shown in the figures as wooden planks but which may be steel channels are supported in a vertical position and tied together in systems as in the present invention. Members 10 are maintained between a front side plate 11 and a back side plate 12. Tension stud bolts 13 pass through front and back side plates 11 and 12 respectively and by means of nuts 14 through 17 on each of bolts 13 maintain the clamping pressure of side plates 11 and 12 against strongback or waler 10. Besides the clamping pressure on opposite edges of the strongback or waler 10 from front and back side plates 11 and 12 pressure is applied to both side faces of strongback or waler 10 in order to further hold them in position and against any movement. On front side plate 11 are turned up portions 18 and 19 on the top and bottom respectively of plate 11 and centered on those top and bottom edges. Portions 18 and 19 press against the inside faces of members 10 near the front side plates with this force opposed by punched off-center washers 21 located between front side plate 11 and nut 15 on each of tension stud bolts 13 and rotated to a position so that due to the off-center punching a part of each washer 21 presses against the outside faces of members 10. Back side plate 12 has a turned up portion 22 centered along its lower edge which presses against the inside faces of members 10 near back side plate 12. Again an opposing force on the outside faces of members 10 is applied by one portion of a vertical slotted washer in the form of a continuous bar or angle 23 through whose slots 24 the tension stud bolts 13 pass. The slotted portion of angles 23 is maintained on bolts 13 between nuts 16 and back side plate 12. A leg of angle 23 perpendicular to the leg with the slots therein presses against the outer faces of structural members 10.

A shelf 26 is formed at a right angle to and integral with back side plate 12 for use as a support or fastener for any form system. For use with the wall form illustrated a plank or wall form portion 27 is attached to shelf 26 by screws 28 passing through shelf 26 and attached into wall form portion 27.

A wall form face 29 is connected to wall form portion 27 by usual means such as nailing or other. On the other side of concrete 31 a similar wall form face 29 supports the concrete 31 in the enclosure and a system similar to that shown in FIGS. 1-3 is found at the other end of screw type wall tie 32.

Screw type wall tie 32 passes through holes 33 and 34 in front side plates 11 and back side plate 12 respectively. These holes 33 and 34 are centered on plates 11 and 12 respectively and are of a large enough size sufficient to receive wall ties 32 including such wall ties as may have enlarged center portions which pass through the wall forms and concrete. The enlarged center portioned type of wall tie is known per se and is not shown in the figures since the dimensions do not form a novel form of the present invention.

Attached to front side plate 11 by tension stud bolts 13 and nuts 14 is a substantially U-shaped housing member 36 having a center opening 37 which is large enough to allow the entry of nut 38 mounted on tie 32 to pass therethrough. This is an aid in the assembly and disassembly of the system. Turned up portions shown on U-shaped housing member 36 are for purposes of strength because of the additional strength of a channel over that of a plate. With the nut 38 positioned within housing member 36 it is maintained therein by a keeper 39 which is a U-shaped front and back washer with each of the legs of the U having a downwardly open slot 41 and 42 in the front and back portions respectively. The slots are wide enough to allow tie 32 to pass therethrough but not wide enough to allow the passage of a nut 38 therethrough. Nut 38 is therefore confined within the front and back portions of keeper 39 once the keeper is slid downward over wall tie 32.

With keeper 39 in place nut 38 is rotated so as to move toward or away from wall form face 29 and by its movement along wall tie 32 to force the movement of wall form face 29 either toward or away from its opposing wall form face on the opposite end of wall tie 32. As can also be seen from a study of the structure disclosed a wrench placed on the end of wall tie 32 which is formed so as to allow holding by such a wrench allows one to prevent the turning of wall tie 32. At the same time the rotation of nut 38, while wall tie 32 is prevented from rotation, if outward along wall tie 32, forces keeper 39 and housing member 36 outward along wall tie 32. This outward movement of housing member 36 which is rigidly attached to front side plate 11 and back side plate 12 by tension bolts 13 causes movement outward along wall tie 32 of both side plates. Since the wall form face and wall form portion 29 and 27 respectively are rigidly attached to back side plate 12, these must also move outward along wall ties 32 thus causing the separation of wall form face 29 from its opposing wall form face which is located on the opposite side of the space which may contain concrete 31, on the opposite end of wall tie 32.

In a similar manner by holding wall tie 32 against rotation and rotating nut 38 along wall tie 32 inward away from the end of wall tie 32 movement of keeper against front side plate 11 along with all attached hardware in a manner similarly described above moves wall form face 29 inward along wall tie 32 closer to an opposing wall form face on the opposite end of wall tie 32.

Members 10 which as discussed above are strongback or walers by their dimensions can be considered to strengthen the construction of the wall forms and thus support a much greater weight and larger surface of concrete 31 between opposing wall form faces 29.

Figure 4:
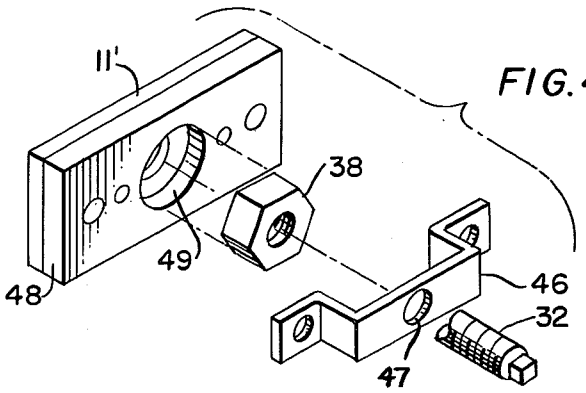
FIG. 4 is a modified form of the system of the present invention.

FIG. 4 which is a modification of the abovedescribed system utilizes a U-shaped housing member 46 having a centered opening 47 to receive a screw-type wall tie 32 on which nut 38 rides. A front side plate $11^1$ similar to front side plate 11 but only partially shown here has attached to it a keeper plate 48 having a center hole 49 large enough in diameter to receive nut 38. In moving the wall forms of the system inwards towards each other the nut 38 is moved along wall tie 32 into hole 49 to apply pressure against front side plate $11^1$ and move attached hardware in a manner described in connection with the first embodiment. Outward movement of nut 38 toward the end of wall tie 32 while at the same time preventing rotation of tie 32 causes adjustment outward of the wall forms away from each other. After any adjustment is made nut 38 is rotated within hole 49 so as to fit against front side plate $11^1$ and prevent outward movement of the wall forms due to pressure of the conceret being poured.

Figure 5:
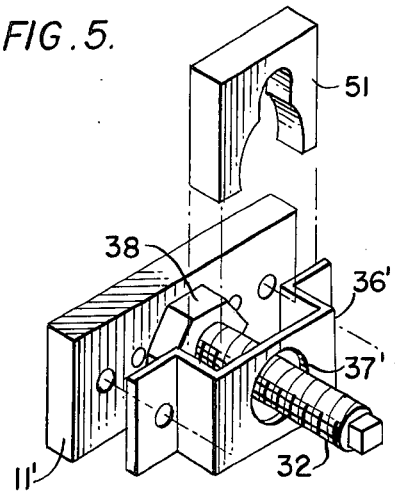
FIGS. 5, 6 and 7 are a further modification of the systems.
Figure 6:
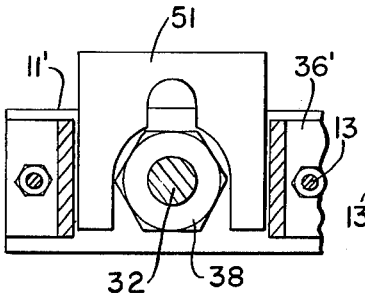
Figure 7:
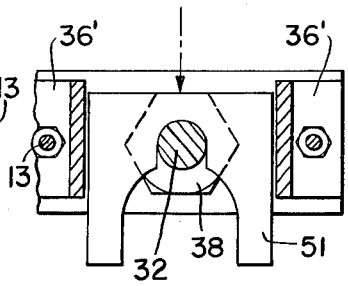

FIGS. 5, 6 and 7 show still another embodiment of the present invention with front side plate $11^1$ connected in the manner of front side plate 11 previously described. A U-shaped housing member $36^1$ which may be constructed in a manner similar to housing member 36 has an enlarged hole $37^1$ through which nut 38 can be passed along screw type wall tie 32. Once nut 38 has been moved up against front side plate $11^1$ a sliding lock plate 51 having a slot therein with a widened portion near the bottom big enough for nut 38 to pass through and a narrower portion above that just sufficient to pass around wall tie 32 is inserted as shown in FIG. 7. Rotating of nut 38 so as to pass it along wall tie 32 exerts forces so as to cause connected portions of housing member 36 and front side plate $11^1$ along with the connected parts as described with the previous embodiments to move inward or outward along wall tie 32 and thereby move wall forms toward or away from each other. Tension stud bolts 13 with nuts thereon are used in all embodiments described and also in the embodiment described in FIG. 8 below.

Figure 8:
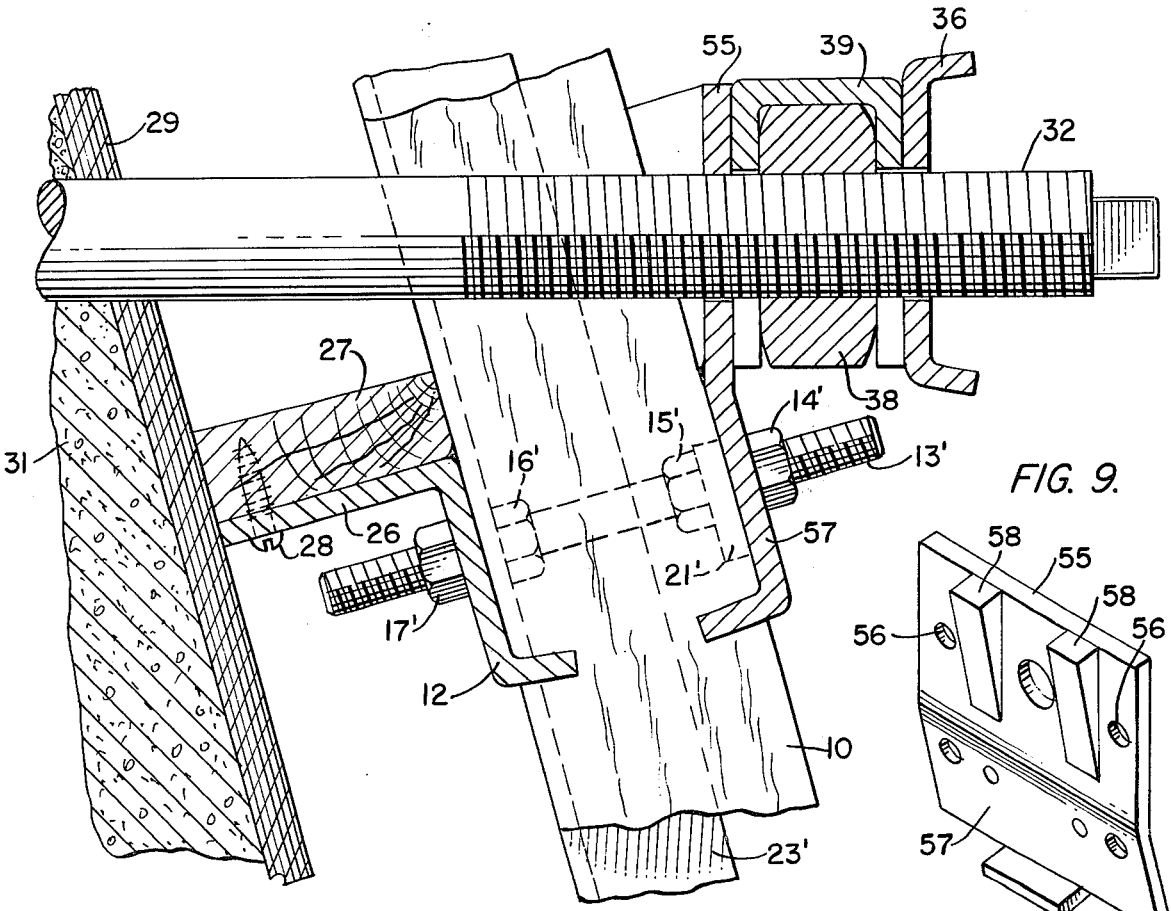
FIG. 8 is a sectioned view of a battered or sloping form utilizing a system of the present invention.

FIG. 8 shows the battered or sloping form wherein the strongback or waler structural members 10 and wall form face 29 may incline from the vertical from 0° to 45°. This modification varies from the embodiment of FIGS. 1 through 3 mainly in the construction of front side plate 55 shown in perspective in FIG. 9. Wall tie 32, housing member 36, keeper 39, back side plate 12, having shelf 26 with the wall form portion 27 attached thereto, and wall form face 29 are similar to those parts as described in connection with FIGS. 1 through 3. In this embodiment tension stud bolts $13^1$ with nuts $14^1$ through $17^1$ connect only from front side plate 55 to back side plate 12 with punched off center washer $21^1$ and vertical slotted washer-angle $23^1$ applying forces against member 10 as previously described. Separate bolts not shown pass through holes 56 in the upper portion of front side plate 55 and connect U-shaped housing member 36 to front side plate 55. Even though the members 10 and face 29 are inclined, adjustment along wall tie 32 by movement of washer 38 is similar as previously described. In order to maintain the form with the slope as desired the lower portion 57 is bent at the angle of slope desired. Wedge shape portions 58 which may be integral with front side plate 55 maintain the support of members 10 in relation to the upper portion of front side plate 55. Thus only slight modification primarily involving a different front side plate 55 allows the use of a battered or sloping form varying in incline from 0° to 45° but utilizing all of the remaining hardware including the wall form of previous embodiments.

FIGS. 10, 11, and 12 illustrate a modified system from that shown, for example, in FIG. 3 with a modified housing member 65 comprising an auxiliary front side plate 61 having U-shaped guide portions 62 attached, as by welding, near the opposite ends of auxiliary front side plate 61. The open ends of the U-shaped guide portions on the auxiliary front side plate 61 are separated from each other so as to allow keeper 39 to pass therebetween when placed over nut 38 assembled on screw type wall tie 32 within housing member 65. The operation of nut 38, tie 32, and keeper 39 in relation to front side plate 11 and housing 65 is the same as before described in relation to housing 36. Also, as before the center opening 63 is big enough for the nut 38 to pass through on tie 32 while slots 41 and 42 are narrow enough to contain nut 38 therebetween when keeper 39 is placed over nut 38 and screw type wall tie 32 and move wall forms as previously described. A bottom ear 64 on auxiliary front side plate 61 merely acts as a stop relative to keeper 39.

In this modified system the connections between the housing member and front side plate 11 and a back side plate 12 differ from prior described systems. The tension stud bolts 13 do not extend completely through housing member 65 but only extend through holes in the free ends of U-shaped guide portions 62 away from the ends attached to auxiliary front side plate 61 as shown clearly in FIG. 11. Cap screws 66 which are short bolts extend back toward tension stud bolts 13 through holes 67 in auxiliary front side plate 61 and the ends of U-shaped guide portions 62 attached to plate 61. Nuts 68 screw onto tension stud bolts 13 on the portions of bolts 13 extending into guide portions 62 and housing member 65 is securely attached to tension stud bolts 13 by means of internally threaded couplers 69 threaded onto the end of each of tension stud bolt 13 against nut 68 and having cap screw 66 screwed into its opposite open end.

Figure 9:
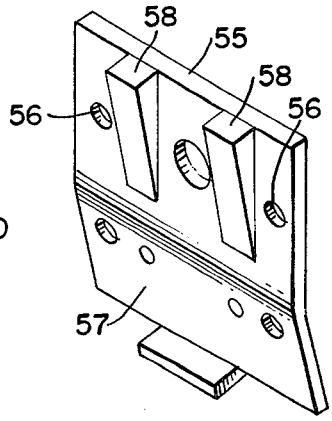
FIG. 9 is a perspective view of a front side plate used with the system of FIG. 8.
Figure 14:
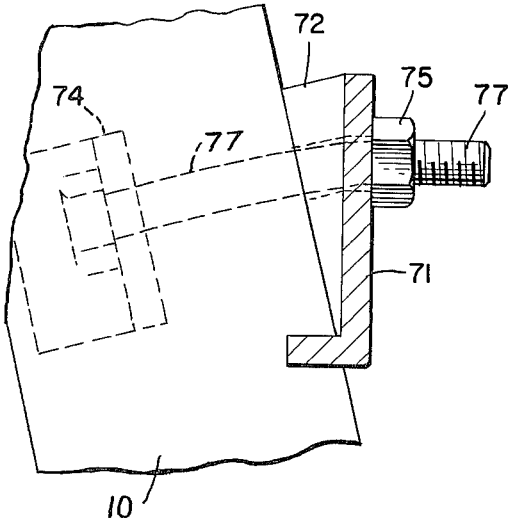
FIG. 14 is an elevational view of the modified form of FIG. 13.

FIGS. 13 and 14 show a variation in the front side plate from that of FIGS. 8 and 9 to also produce the battered or sloping form to incline the strongback or waler structural members from the vertical at an angle from 0° to 45°. In this figure there is shown front side plate 71 having wedge shaped portions 72 near each end which may be integral with or separate from front side plate 71 and which maintain support members 10 (only one shown but one would be located on each side of turned up portion 73) at an incline. An angle connector 74 connected to structural member 10 by means such as a wood screw 76 is connected, along with or without a back side plate by nut 75 on each of bent or curved tension bolts 77 (one shown). Bent or curved tension bolts 77 are used with this variation because of the differences in the front side plate of this embodiment from the embodiment of FIGS. 8 and 9.

Although back side plates have been discussed with each of the embodiments, these back side plates may be eliminated in some systems by connection of the front side plate directly to the building members which may be studs or channels attached directly to wall forms as illustrated with the system of FIGS. 13 and 14.

Figure 15:
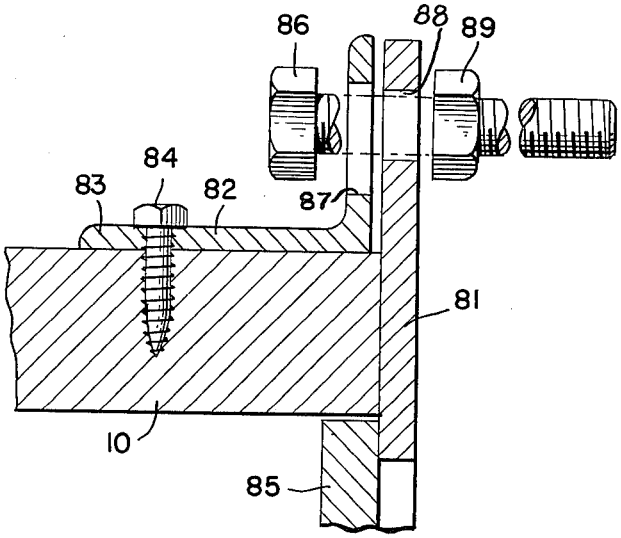
FIGS. 15 and 16 are top sectional views of means for attachment of front plates to wooden structural members.
Figure 16:
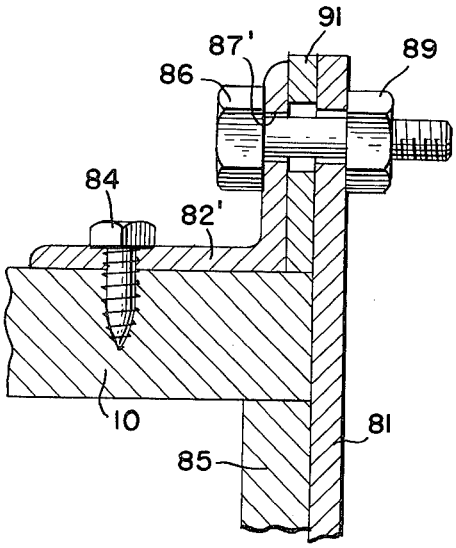
Figure 17:
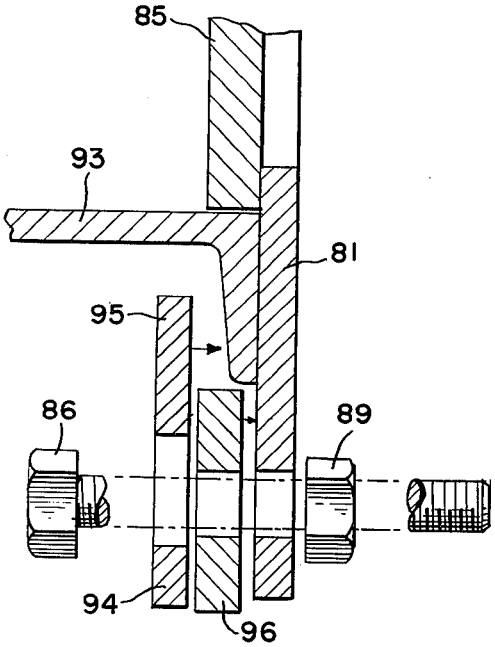
FIG. 17 is a top sectional view of a means for attachment of a front plate to a steel structural member.

Different ways of connecting structural columns, strongbacks, or walers directly to front side plates are illustrated in FIGS. 15, 16, and 17.

In FIG. 15 a wooden structural member 10 is connected to front side plate 81 by means of a vertical slotted continuous bar or angle 82. Although shown only in a top plan section in FIG. 15, bar or angle 82 may be either similar to angle connector 74 or similar to continuous bar or angle 23 (see FIG. 3) with a slot or slots similar to slots 24 and additionally an opening or openings in leg 83 to permit entry of wood screw 84 therethrough into structural member 10. A tension bolt 86 with a head of greater diameter than the width of slot 87 of bar or angle 82 passes through slot 87 and through an opening 88 near an end of front side plate 81 to attach and hold bar or angle 82 and structural member 10 to front side plate 81 with nut 89. Structural member 10 is further held against horizontal movement by turned up portion 85 on front side plate 81 on the opposite side of structural member 10 from bar or angle 82.

Further steadying of structural member 10 against horizontal movement may be obtained by the variation shown in FIG. 16 where a punched off center washer 91, similar to washer 21 of FIG. 3, is held by tensin bolt 86 between the bar or angle $82^1$ and front side plate 81. In this variation from FIG. 15 it should be noted that bar or angle $82^1$ need not have a slot 87 but will work satisfactorily also if the opening $87^1$ is merely a round opening to receive tension bolt 86. In this latter case adjustment to hold structural member 10 against turned up portion 85 is made by moving punched off center washer 91 so that an edge presses against a side of structural member 10 opposite from its side which is against turned up portion 85. In cases where the structural member is a steel channel angle or bar 93 instead of a wood member, connection directly to the structural member by front side plate 81 is made by the system illustrated in FIG. 17.

In FIG. 17 tension bolt 86 passes through a punched off center washer 94 with a longer extended portion 85 extending inward from the end of front side plate 81 toward steel channel angle or bar 93, and through a washer 96, and then through an opening near the end of front side plate 81 to receive nut 89. This structure will be located on both ends of front side plate 81 with steel channel angle or bar 93 on each side of turned up portion 85. In this system washer 96 should effectively be thin enough to allow extended portion 95 of punched off center washer 94 to be pressed against a portion of a leg 97 of steel channel angle or bar 93 which extends parallel to front side plate 81 and is pressed thereby against plate 81 and prevented against horizontal movement by opposing turned up portions 85 and washer 96.

Among the advantages of the present invention as shown in the description of several embodiments is the interchangeable hardware and the adaptability to almost any type of wall form or mechanism for movement of panels along with the simplicity allowing assembly or disassembly with a minimum of tools. In fact a couple of wrenches can be used for full adjustment and assembly or disassembly of the structures.

It will be obvious to those skilled in the art that various changes may be made without departing from the scope of the invention and the invention is not to be considered limited to what is shown in the drawings and described in the specification.

I claim:

1. Apparatus to adjust and maintain spacing between building members comprising a front side plate having means to attach said front side plate to one of the building members, a screw type wall tie adapted to extend between the building members and passing through said front side plate, a nut mounted for rotation on said screw type wall tie, means to enclose said nut attached to said front side plate and enclosing said nut, said wall tie passing substantially through laterally centered openings in said front side plate and said nut enclosing means, means to receive and attach to said screw type wall tie mounted on the opposite end of said wall tie and adapted to be attached to the other of the building members, said means to enclose said nut including an auxiliary front side plate having U-shaped guide portions on laterally opposite ends of said auxiliary front side plate, and means attaching said auxiliary front side plate to said front side plate.

2. Apparatus of claim 1, further characterized by said means to attach said auxiliary front side plate to said front side plate including tension stud bolts connecting said front side plate and said auxiliary front side plate.

3. Apparatus of claim 2, further characterized by said means to attach said auxiliary front side plate to said front side plate further including said tension stud bolts attached to said auxiliary front side plate by extending through and attachment to said U-shaped guide portions, cap screw means extending through opposite ends of said U-shaped guide portions from those receiving said tension stud bolts near laterally opposite ends of said auxiliary front side plate and internally threaded couplers connecting ends of said tension stud bolts to adjacently located cap screw means.

4. Apparatus of claim 1, further characterized by a keeper extending over said tie on both sides of said nut, said keeper having connected front and back portions, each said front and back portions having slots therein.

5. Apparatus of claim 1, further characterized by said laterally centered opening in said nut enclosing means having a diameter larger than the diameter of said nut.

6. Apparatus to adjust and maintain spacing between building members comprising a front side plate having means to attach said front side plate to one of the building members, a screw type wall tie adapted to extend between the building members and passing through said front side plate, a nut mounted for rotation on said screw type wall tie, means to enclose said nut attached to said front side plate and enclosing said nut, said wall tie passing substantially through laterally centered openings in said front side plate and said nut enclosing means, and means to receive and attach to said screw type wall tie mounted on the opposite end of said wall tie and adapted to be attached to the other of the building members, said front side plate having wedge shaped portions located adjacent thereto on opposite sides of its said laterally centered opening.

7. Apparatus of claim 6, further characterized by said means to attach said front side plate to one of the building members including a tension bolt having a curved portion.

8. Apparatus of claim 7, further characterized by said means to attach said front side plate to one of the building members further including angle connecting means adapted to be attached to the building member, said tension bolt connected between said front side plate and said angle connecting means.

9. Apparatus of claim 6, further characterized by said wedge shaped portions being integral with said front side plate.

10. Apparatus to adjust and maintain spacing between building members comprising a front side plate having means to attach said front side plate to one of the building members, said front side plate also having a laterally centered bracing portion projection therefrom, a screw type wall tie adapted to extend between the building members and passing through said front said plate, a nut mounted for rotation on said screw type wall tie, means to enclose said nut attached to said front side plate and enclosing said nut, said wall tie passing substantially through laterally centered openings in said front side plate and said nut enclosing means, and means to receive and attach to said screw type wall tie mounted on the opposite end of said wall tie and adapted to be attached to the other of the building members, said means to attach said front side plate to one of the building members including a structural member adapted to be connected to the building member, means holding said structural member against said front side plate and against said laterally centered bracing portion, said holding means having horizontally extending slots for adjustment of said structural member against said laterally centered bracing portion whereby different size structural members may be accommodated.

11. Apparatus of claim 10, further characterized by said structural member being made of wood or similar material, said holding means including an angle connecting means with one leg connected to said structural member and the other leg having a tension bolt through said slot for connection to said front side plate.

12. Apparatus of claim 11, further characterized by said angle connecting means being a continuous bar with a series of horizontally extending slots arranged vertically from each other.

13. Apparatus of claim 10, further characterized by said structural member being made of wood or similar material, said holding means including an angle connecting means with one leg connected to said structural member and the other leg having a tension bolt therethrough for connection to said front side plate and an off center washer between said angle connecting means and said front side plate.

14. Apparatus of claim 10, further characterized by said structural member being a metal channel, said holding means including an off center washer with a portion extended overlapping said structural member to press said structural member against said front side plate, and a washer between said off center washer and said front side plate having a thickness substantially the thickness of the end of said structural member included between said off center washer and said front side plate and a tension bolt passing through and connecting said washers and said front side plate.

* * * * *